US005236279A

United States Patent [19]

Grinager

[11] Patent Number: 5,236,279

[45] Date of Patent: Aug. 17, 1993

[54] SELF-PROPELLED CONCRETE TAMPING APPARATUS

[76] Inventor: Kenneth P. Grinager, 8625 Nash Way, Sacramento, Calif. 95828

[21] Appl. No.: 941,657

[22] Filed: Sep. 8, 1992

[51] Int. Cl.[5] ..... E01C 19/00

[52] U.S. Cl. ..... 404/133.05

[58] Field of Search ..... 404/133.05, 101-105

[56] References Cited

U.S. PATENT DOCUMENTS

| | | | |
|---|---|---|---|
| 2,856,828 | 10/1958 | Brown et al. | 94/48 |
| 2,894,435 | 7/1959 | Brown et al. | 94/48 |
| 2,917,979 | 12/1959 | Dening et al. | 94/45 |
| 3,160,216 | 12/1964 | Ormes | 173/24 |
| 3,386,353 | 6/1968 | Wells | 94/48 |
| 3,453,940 | 7/1969 | Berkhoudt et al. | 94/48 |
| 3,534,669 | 10/1970 | Judd | 94/48 |
| 3,807,067 | 4/1974 | Cloud | 404/133.05 X |
| 3,997,278 | 12/1976 | Reidl | 404/133 |
| 4,828,428 | 5/1989 | Anderson | 404/133.05 X |

*Primary Examiner*—Thuy M. Bui

*Attorney, Agent, or Firm*—John P. O'Banion

[57] ABSTRACT

A self-propelled concrete tamping apparatus (10) in which a tamper screen (70) is rapidly moved in vertical reciprocating strokes upon concrete or other paving material while being guided by an operator. Engine (18) powers drive wheel (28) which propels the apparatus backward, as well as powers tamper screen (70) with reciprocating motion. Drive wheel (28) and free wheel (30) are adjustable in position to allow for adjustment of tamping depth.

17 Claims, 6 Drawing Sheets

SELF-PROPELLED CONCRETE TAMPING APPARATUS

BACKGROUND OF THE INVENTION

1. Field of the Invention

This invention relates generally to concrete tamping devices and, more particularly, to an engine-driven tamping machine which can be easily maneuvered to compress paving material over a broad path, or for compressing or tamping dirt or other material.

2. Description of the Background Art

Several variations of wheel movable tamping devices are heretofore known. Many of these devices mainly consist of an impactor plate adapted to contact the material to be compressed or tamped, and a means associated therewith to cause the impactor plate to vibrate. Other devices employ an eccentric drive shaft to reciprocate a tamping foot structure.

For example, U.S. Pat. No. No. 2,917,979 issued to Dening et al. on Dec. 22, 1959 discloses an engine-driven tamper which can be hand guided or driven, and which can tamp concrete with a rotary reciprocating motion. The tamping element is disc-shaped and rotates eccentrically. U.S. Pat. No. 3,534,669 issued to Judd on Oct. 20, 1970 discloses a hand guided, engine-driven tamper designed for tamping dirt in an open trench on both sides of a pipeline. The apparatus includes a pair of laterally spaced tampers supported on a movable carriage for rapid vertical reciprocating motion, and is supported by a pair of wheels which guide the support the entire apparatus. U.S. Pat. No. 3,386,353 issued to Wells on Jun. 4, 1968 discloses a hand guided, engine-driven tamper having a rectangular float plate attached to a vibrating mechanism. U.S. Pat. No. 3,453,940 issued to Berkhoudt et al. on Jul. 8, 1969 discloses an engine-powered tamper of the vibratory type, which is hand guided. Wheels are provide to move the apparatus from one site to another, but are not used to guide the apparatus when in use. Instead, the user guides the tamper while it is in its upstroke and the tamping shoe is off of the ground. U.S. Pat. No. 2,85,828 issued to Brown et al. on Oct. 21, 1958 discloses a tamper which is engine-driven and hand guided. Eccentric weights are used to carry vibration to an impactor plate which is used for tamping dirt, paving material, etc. U.S. Pat. No. 2,894,435 issued to Brown on Jul. 14, 1959 discloses a tamper of a similar design to U.S. Pat. No. 2,856,828, except that the impactor blade is replaceable. Eccentric weights are still used to cause vibration. U.S. Pat. No. 3,997,278 issued to Riedl on Dec. 14, 1976 discloses an engine-powered tamper which is hand guided and supported by means of laterally spaced wheels. A rocker-type shaft has tamper pads in a fore and aft plane which are caused to rock, or oscillate, to tamp surface material. U.S. Pat. No. 3,160,216 issued to Ormes on Dec. 8, 1964 discloses an engine-powered, hand guided tamper for use on roofs or other surfaces where it is necessary to remove surface gravel, slag, felt, etc. The apparatus includes a plurality of tamper elements which operate with a reciprocating motion.

However, so far as is known, no hand-guided, wheel movable tamping devices have been devised which provide a broad tamping screen which can be rapidly reciprocated in vertical movement and driven forward at variable speed controlled by an operator, and which provide for powering the wheels for self-propelled operation. Forward movement of other devices has generally depended upon the bouncing effect of internal weights as they are reciprocated in a drum, or upon an operator pulling the unit forward.

The present invention overcomes the deficiencies in the foregoing described devices. An operator controlled variable speed driving wheel is used to propel the unit forward, and the vertical reciprocating action of the tamping screen is applied to a wide surface area. This provides and efficient, effective device for tamping concrete or other paving material over a broad pathway.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

By way of example and not of limitation, the present invention generally comprises a self-propelled concrete tamping apparatus having a frame supported by a pair of wheels at one end, and further supported by a pair of reciprocating tamper pistons at the other end. One of the wheels is engine-driven, while the other wheel freely rotates. The tamper pistons extend downwardly from the frame of the apparatus and are guided by hollow tamper piston housings attached to the frame. Located in the tamper piston housings between the upper end of the tamper pistons and the frame are springs used to pre-load the tamper pistons. Also included is a generally flat tamper screen which transverses the lower end of the tamper pistons.

The height of the wheels is adjustable so that the tamping depth can be varied. In addition, the tamper screen can easily be removed for repair or replacement, which is particularly useful where different screen mesh sizes are desired.

The engine is coupled to the driven wheel by a chain drive having a spring tensioner. A split axle configuration is used with a slip clutch positioned between the two axle members. In this way, "spinning out" of the driven wheel can be avoided if power is applied to rapidly or if the driven wheel gets caught. The axle includes a sprocket which engages the chain drive.

The engine is also coupled to the tamper pistons by a chain drive which engages a unitary axle transversing the upper portion of the frame. Each end of the axle includes an eccentrically located shaft extension which engages bushings in the upper end of downwardly extending tamper control arms. The lower ends of the tamper control arms are coupled to the tamper pistons. Rotation of this axle causes the tamper pistons to reciprocate in the tamper piston housings, which in turn causes the tamper screen to reciprocate.

An object of the invention is to provide a vertical reciprocating tamping screen for compacting and tamping a concrete pour along a broad pathway.

Another object of the invention is to provide a wide vertical reciprocating tamping screen which may be easily changed so that various tamping and surfacing effects can be easily created.

Another object of the invention is to provide a concrete tamper which can be easily guided by the operator.

Another object of the invention is to provide a concrete tamper which is self-propelled.

Another object of the invention is to permit the operator to control the speed of forward motion as well as the speed of tamping.

Another object of the invention to provide for controlling tamping depth.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus which is generally shown in FIG. 1 through FIG. 6. It ill be appreciated that the apparatus may vary as to configuration and as to details of the parts without departing from the basic concepts as disclosed herein.

Figure 1:
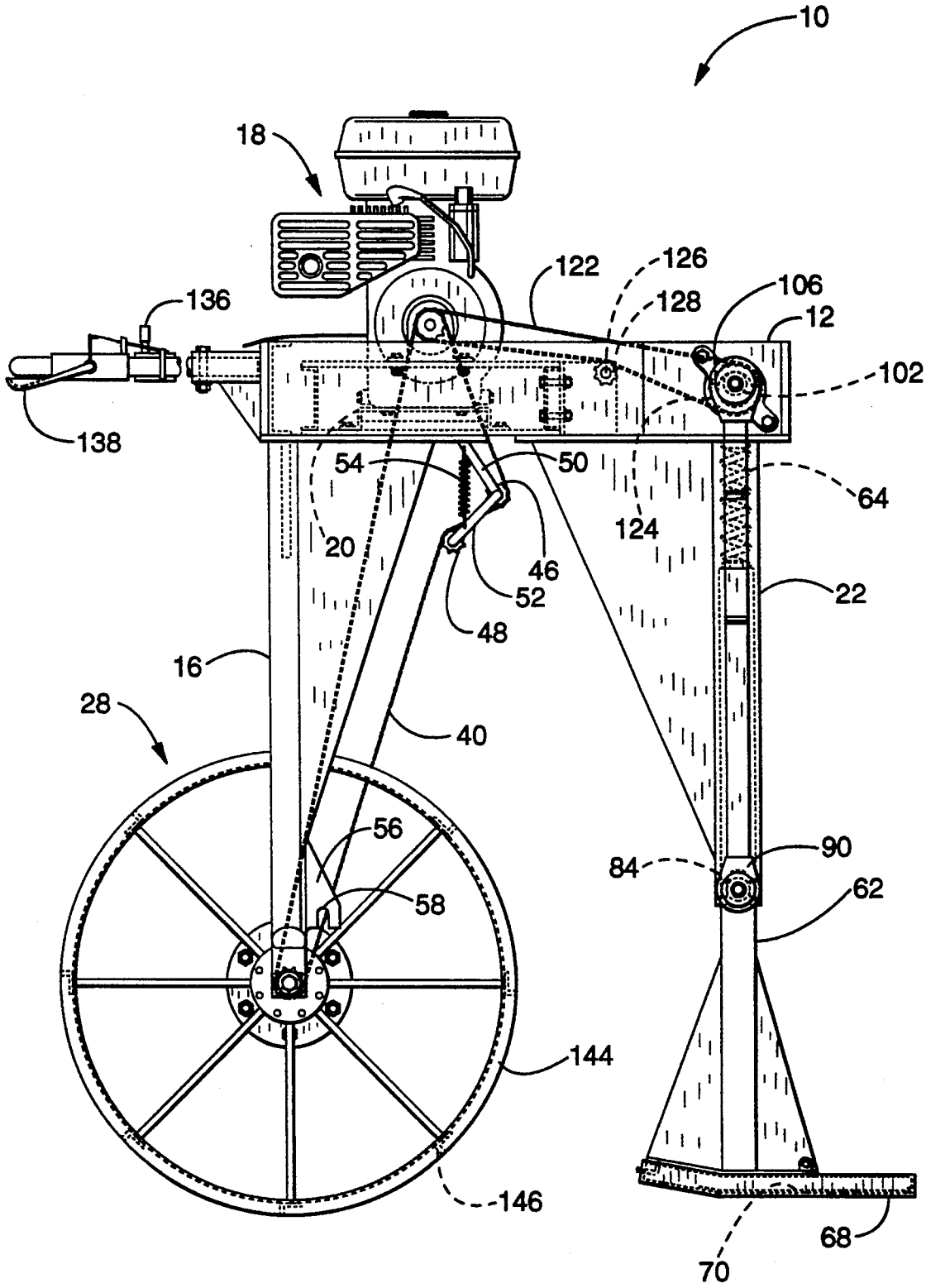
FIG. 1 is a side elevation view of the apparatus of the present invention.
Figure 2:
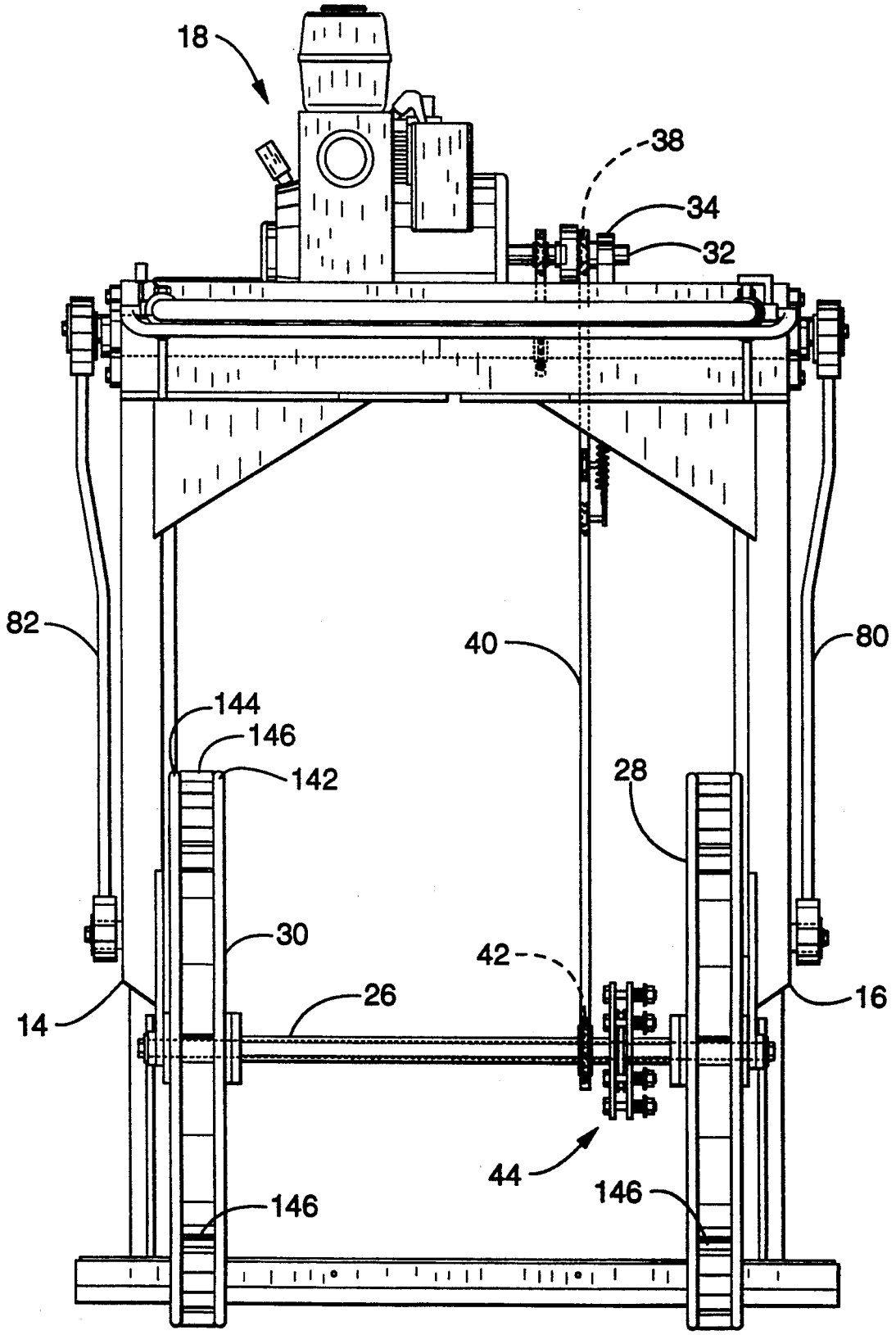
FIG. 2 is front elevation view of the apparatus.

Referring to FIG. 1 and FIG. 2, the apparatus 10 as disclosed herein includes a carriage frame 12 to which a pair of wheel support members 14, 16 are attached. Wheel support members 14, 16 depend downwardly from carriage frame 12, and are positioned laterally at one end of carriage frame 12 as shown.

The apparatus is powered by an engine 18 which can be an internal combustion engine, or an electric or hydraulic motor. Engine 18 can be mounted directly to carriage frame 12 or, preferably, by means of a mounting platform 20 which is attached to carriage frame 12.

Figure 3:
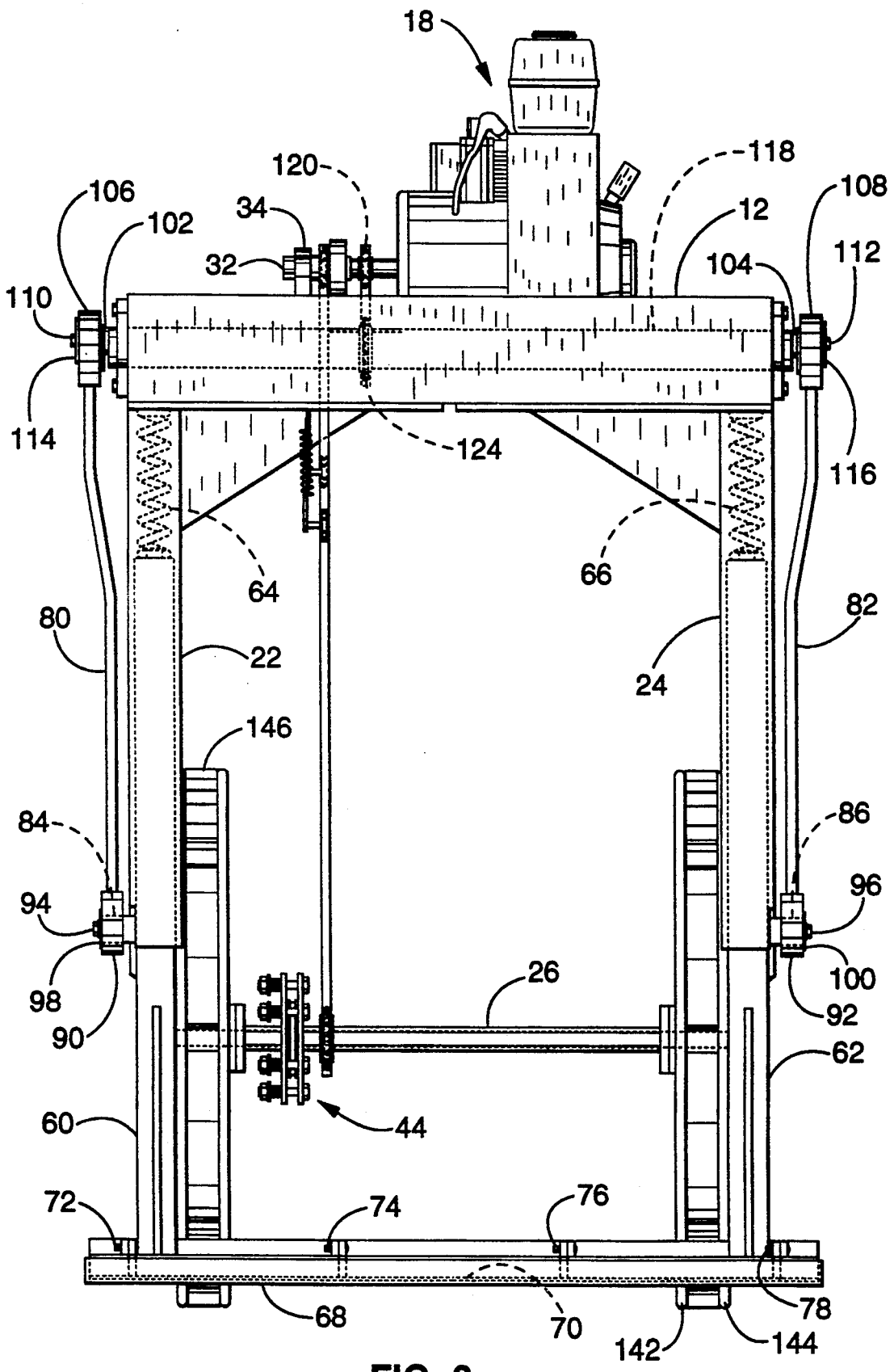
FIG. 3 is a rear elevation view of the apparatus.

Referring to FIG. 1 and FIG. 3, tamper piston housings 22, 24 are attached to the carriage frame 12 and depend downward therefrom. Tamper piston housings 22, 24 are positioned laterally at the end of carriage frame 12 which is opposite wheel support members 14, 16.

Therefore, it can be seen that the combination of carriage frame 12, wheel support members 14, 16 and tamper piston housings form a frame structure supported at each corner by a vertical downward-depending support. It can be appreciated that other similar configurations could be readily constructed without departing significantly from the design disclosed herein.

The lower ends of wheel support members 14, 16 are coupled to wheel support axle 26. Typically, the lower ends of wheel support members 14, 16 are fork-shaped with a slot which receives wheel axle 26. Wheel axle 26 is coupled to drive wheel 28 and free wheel 30 in any known fashion suitable for permitting rotation thereof. In this manner, the apparatus rides on and is supported by these wheels.

Referring now to FIG. 1 and FIG. 2, engine 18 rotationally powers engine drive shaft 32 which extends horizontally from the engine 18. Bearings 34, 36 secure engine drive shaft 32 in horizontal alignment while permitting engine drive shaft 32 to rotate. A wheel drive sprocket 38 is secured concentrically to engine drive shaft 32 and rotates in unison with engine drive shaft 32.

One end of a looped wheel drive chain 40 engages wheel drive sprocket 38, while the other end engages wheel axle sprocket 42. Wheel axle sprocket 42 is secured to wheel axle 26. Wheel axle 26 is frictionally coupled to drive wheel 28 through an adjustable slip clutch 44. Free wheel 30 is coupled to wheel axle 26 in any known fashion which permits it to rotate independently of rotation of wheel axle 26.

Referring to FIG. 1, the height of drive wheel 28 and free wheel 30 relative to carriage frame 12 can be adjusted, while at the same time maintaining constant tension on wheel drive chain 40. This is accomplished by an assembly comprising an idler sprocket 46 and a take-up sprocket 48, each of which is rotationally coupled to adjustment arms 50, 52 as shown. One end of adjustment arm 50 is pivotally coupled to the underside of carriage frame 12. The other end of adjustment arm 50 is pivotally coupled to one end of adjustment arm 52, at which point idler sprocket 46 is also coupled in a manner which permits rotation. Take-up sprocket 48 is rotationally coupled to the other end of adjustment arm 52. One end of take-up spring 54 is attached to the end of adjustment arm 50 nearest carriage frame 12, while the other end of take-up spring 54 is attached to the end of adjustment arm 52 nearest take-up sprocket 48. In this manner, take-up spring 54 applies constant tension to wheel drive chain 40.

In order to change the height of drive wheel 28 and free wheel 30, there is provided an axle support flange 56 on each of wheel support members 14, 16. A slot 58 in each flange 56 receives wheel axle 26 to facilitate this adjustment.

Referring to FIG. 1 and FIG. 3, the apparatus includes a tamper drive means generally comprising a pair of tamper pistons 60, 62 which engage tamper piston housings 22, 24, respectively. Tamper pistons 60, 62 are freely movable in a vertical direction and are slidably coupled by known means within tamper piston housings 22, 24.

Upward movement of tamper pistons 60, 62 compresses tamper piston springs 64, 66 against carriage frame 12. This compression pre-loads energy on the upward stroke of tamper pistons 60, 62 with this energy being released on the downward stroke of tamper pistons 60, 62.

The lower ends of tamper pistons 60, 62 are secured to tamper screen holder 68. Tamper screen 70 is coupled to tamper screen holder 68 by removable pins 72, 74, 76 and 78. These pins can be readily removed when desired so that the a variety of different tamper screens 70 can be quickly and easily removed or attached.

Referring now to FIG. 3, the vertical position of tamper pistons 60, 62 is controlled by the position of the tamper control arms 80, 82 which are pivotally coupled to tamper piston arms 84, 86. Tamper piston arms 84, 86 are preferably small shafts extending horizontally from tamper pistons 62, 64. Tamper piston arms 84, 86 are coupled to bushings 90, 92 by bolts 94, 96 and capture plates 98, 100 to prevent the bushings from sliding laterally and keeping the bushings rotationally engaged with tamper piston arms 84, 86.

Tamper control arms 80, 82 are rigid members coupled at their upper ends to drive shaft cams 102, 104. Cam bushings 106, 108 are coupled to drive shaft cams 102, 104 by bolts 110, 112 and capture plates 114, 116.

Figure 4:
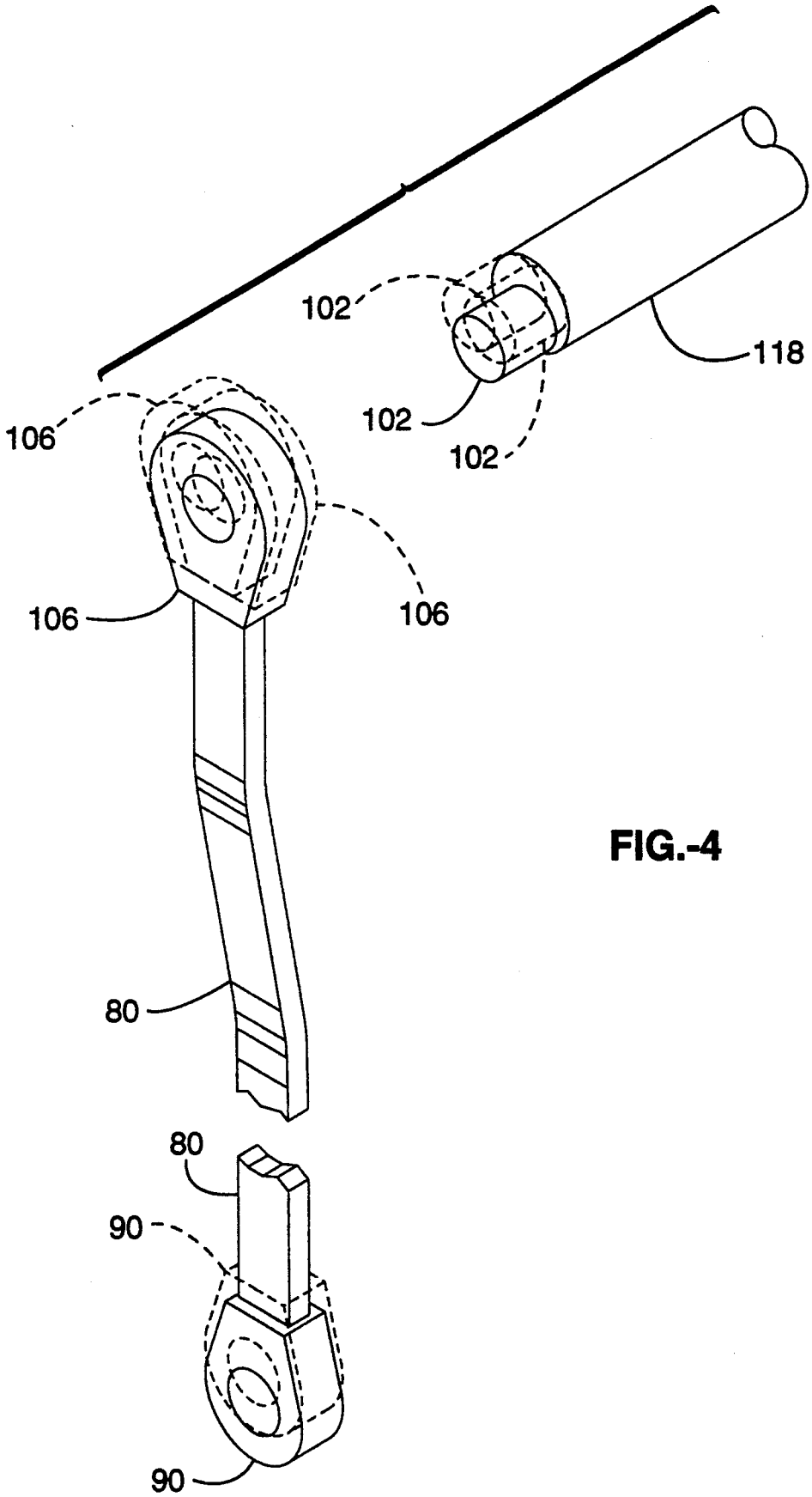
FIG. 4 is an exploded view of the eccentric tamper drive coupling of the apparatus.

Referring also to FIG. 4, drive shaft cams 102, 104 are eccentrically located on each end of tamper drive shaft 118. Therefore, when tamper drive shaft 118 rotates, the eccentric rotation of drive shaft cams 102, 104 causes tamper control arms 80, 82 to reciprocate in a vertical direction. This causes tamper pistons 60, 62 and tamper screen 70 to move with reciprocating motion.

Coupled to engine drive shaft 32 is tamper drive sprocket 120. Referring also to FIG. 1, one end of looped tamper drive chain 122 engages tamper drive sprocket 120 as well as tamper drive shaft sprocket 124 which is coupled to tamper drive shaft 118.

An idler shaft 126 attached to carriage frame 12 supports idler sprocket 128 which engages tamper drive chain 122 to keep it in constant tension and in proper alignment.

Figure 5:
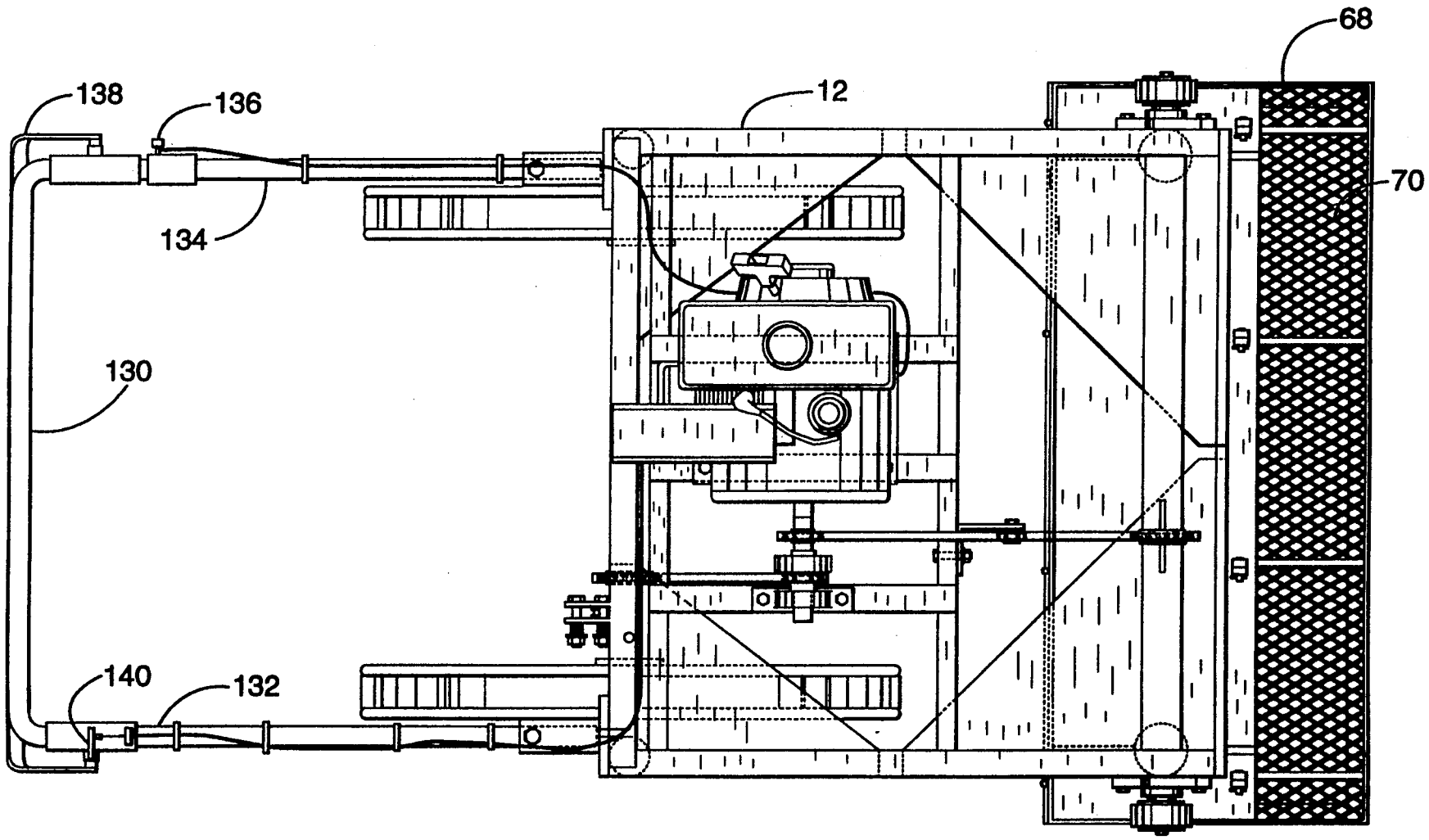
FIG. 5 is a plan view of the apparatus.

Referring now to FIG. 5, a horizontal graspable handle 130 is secured at each end to the ends of handle support arms 132, 134 which are affixed at their other ends to carriage frame 12. Handle support arms 132, 134 extend outward in a horizontal plane and are substantially parallel to in relation to each other.

Secured to the handle 130 is a speed control lever 136 by which the operator can selectively vary the speed of the engine in known fashion. A safety release bar 138 is affixed in parallel alignment to the handle 130 and operates a cut-off switch 140 such that, when the operator releases the safety release bar 138, the engine ceases to run.

Figure 6:
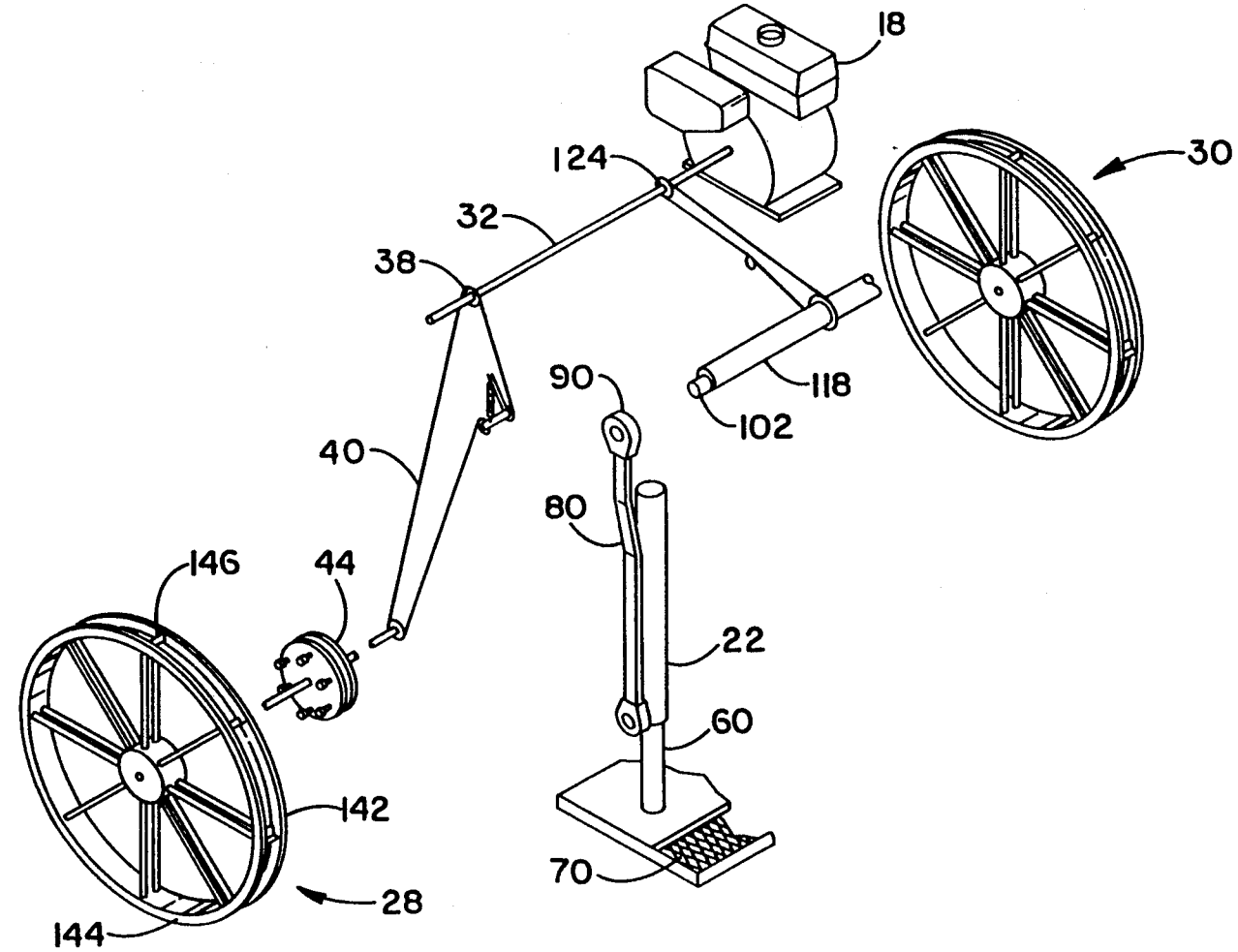
FIG. 6 is a perspective view, generally schematic in nature, showing the drive mechanism of the apparatus.

Referring to FIG. 1 and FIG. 6 together, the apparatus 10 operates in the following manner. Operation of engine 18 causes engine drive shaft 32 to rotate in a counterclockwise direction. As a result, wheel drive sprocket 38 rotates in a counterclockwise direction as does wheel drive chain 40 and slip clutch 44. This imparts rotational motion to drive wheel 28 which rotates in a counterclockwise direction thereby causing the apparatus 10 to move toward the operator. In other words, the operator walks backwards as the apparatus operates. This is particularly important where the surface being tamped is freshly poured concrete since it would be undesirable for the operator or the wheels of the apparatus to disturb the concrete once tamped.

Drive wheel 28 includes an inner rim 142 and an outer rim 144. Disposed therebetween are a plurality of cleats 146 which serve to provide for positive engagement of drive wheel 28 and the surface being tamped. This is particularly noteworthy where the material being tamped is freshly poured concrete and does not present a hard surface for traction. Free wheel 30 is of a similar configuration, except that it simply rotates in response to movement of the apparatus 10.

Rotation of engine drive shaft 32 also causes tamper drive sprocket 124 to rotate in a counterclockwise direction. As a result, tamper drive chain rotates in a counterclockwise direction as does tamper shaft sprocket 124. This imparts rotational motion to tamper drive shaft 118. When tamper drive shaft 118 rotates (whether clockwise or counterclockwise), the eccentric positioning of drive shaft cam 102 causes tamper control arm 80 to move with vertical reciprocating motion. Similarly, tamper control arm 82 moves with vertical reciprocating motion. Therefore, tamper screen 70 similarly moves with vertical reciprocating motion.

Accordingly, it will be seen that this invention provides an efficient, easy to use tamping apparatus for concrete, dirt and the like. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. An engine-driven concrete tamping apparatus, comprising:

(a) a carriage frame, one end of said carriage frame including a pair of laterally spaced wheel support members extending downwardly therefrom, the other end of said carriage frame including a pair of laterally spaced tamper shaft housings extending downwardly therefrom;

(b) an engine, said engine mounted to said carriage frame;

(c) a pair of laterally spaced wheels, said wheels rotatably coupled to said wheel support members;

(d) wheel drive means for imparting rotational motion to at least one of said wheels, said wheel drive means coupled to said engine;

(e) a plurality of laterally spaced tamper pistons, said tamper pistons extending downwardly from said carriage frame, said tamper pistons slidably coupled to said tamper shaft housings;

(f) tamper drive means for imparting reciprocating motion to said tamper pistons, said tamper drive means coupled to said engine, said tamper drive means coupled to said tamper shafts; and a removable tamper screen, said tamper screen coupled to said tamper pistons.

2. The apparatus recited in claim 1, wherein said tamper drive means comprises:

(a) a tamper drive shaft, said tamper drive shaft having eccentric sections at opposite ends, said drive shaft transversing said tamper pistons; and (b) a pair of tamper drive arms, said tamper drive arms extending downwardly from said tamper drive shaft, one end of each said tamper drive arm coupled to one of said eccentric sections, the other end of each said tamper drive arm coupled to one of said tamper pistons.

3. The apparatus recited in claim 1, wherein said wheel drive means comprises:

(a) a wheel axle, said wheel axle extending transversely between said wheels;

(b) a driven gear sprocket, said driven gear sprocket coupled to said axle;

(c) an engine drive shaft, said engine drive shaft coupled to said engine;

(d) a driving gear sprocket, said driving gear sprocket coupled to said engine drive shaft;

(e) a drive chain, said drive chain coupled to said driving gear sprocket and said driven gear sprocket; and (f) chain tensioning means for applying constant tension to said chain.

4. The apparatus recited in claim 1, further comprising:

(a) a pair of guide arms, said guide arms extending from said carriage frame; and (b) a handle member, said handle member extending transversely between said guide arms.

5. The apparatus recited in claim 1, wherein the distance between said carriage frame and said wheels is adjustable.

6. The apparatus recited in claim 3, further comprising a slip clutch, said slip clutch positioned between one of said wheels and said axle, said slip clutch frictionally coupling said wheel to said axle.

7. A hand operated, self-propelled concrete tamper, comprising:

(a) a frame, one end of said frame supported by a pair of laterally spaced wheels;

(b) an engine, said engine mounted to said frame;

(c) wheel drive means for powering at least one of said wheels, said wheel drive means coupled to said engine;

(d) a pair of laterally spaced tamper pistons, said tamper pistons extending downwardly from the end of said frame opposite said wheels;

(e) a tamper drive shaft, said tamper drive shaft rotatably coupled to said frame, said tamper drive shaft having eccentrically positioned extension members at each end;

(f) a pair of tamper drive arms, said tamper drive arms extending downwardly from said tamper drive shaft, one end of each said tamper drive arm coupled to one of said eccentric sections, the other end of each said tamper drive arm coupled to one of said tamper pistons; and (g) a removable tamper screen, said tamper screen coupled to said tamper pistons.

8. The apparatus recited in claim 7, wherein said wheel drive means comprises:

(a) a wheel axle, said wheel axle extending transversely between said wheels;

(b) a first drive sprocket, said first drive sprocket coupled to said axle;

(c) an engine drive shaft, said engine drive shaft coupled to said engine;

(d) a second drive sprocket, said second drive sprocket coupled to said engine drive shaft;

(e) a drive chain, said drive chain coupled to said first and second drive sprockets; and (f) chain tensioning means for applying constant tension to said chain.

9. The apparatus recited in claim 8, further comprising a clutch, said clutch positioned between said wheel axle and one of said powered wheels, said clutch frictionally coupling said wheel axle to said powered wheel.

10. The apparatus recited in claim 9, further comprising a handle, said handle extending from the end of said frame opposite said wheels.

11. The apparatus recited in claim 10, further comprising throttle means for varying the speed of said powered wheel and said tamper pistons, said throttle means coupled to said engine.

12. The apparatus recited in claim 10, wherein the distance between said carriage frame and said wheels is adjustable.

13. A self-propelled concrete tamper, comprising:

(a) a moveable carriage, said carriage having a first end and a second end;

(b) a wheel support frame, said wheel support frame depending from said first end of said carriage in a downward direction;

(c) a tamper shaft support frame, said tamper shaft support frame depending from said second end of said carriage in a downward direction;

(d) an engine, said engine coupled to said engine carriage;

(e) a pair of laterally spaced wheels, said wheels rotatably coupled to said wheel support frame, one of said wheels being coupled to said engine;

(f) a pair of laterally spaced reciprocating tamper shafts, said tamper shafts extending downwardly from said carriage, said tamper shafts slidably engaging said tamper shaft support frame, said tamper shafts coupled to said engine; and (g) a tamper screen, said tamper screen coupled to said tamper shafts.

14. The apparatus recited in claim 13, further comprising:

(a) a clutch;

(b) a wheel axle, said wheel axle coupled to said engine, one end of said wheel axle coupled to said clutch, the other end of said wheel axle coupled to one of said wheels, said clutch coupled to the other of said wheels.

15. The apparatus recited in claim 13, wherein said tamper screen includes means for quick release from said tamper shafts.

16. The apparatus recited in claim 14, further comprising a tamper shaft drive axle, said tamper shaft drive axle coupled to said engine, each end of aid tamper shaft drive axle including an eccentric cam, each said eccentric cam pivotally coupled to one of said tamper shafts, whereby rotation of said tamper shaft drive axle imparts reciprocating motion to said tamper shafts.

17. The apparatus recited in claim 16, further comprising:

(a) a pair of guide arms, said guide arms extending from said carriage frame; and (b) a handle member, said handle member extending transversely between said guide arms.

* * * * *